United States Patent [19]

Pryor, Jr. et al.

[11] 4,005,384

[45] Jan. 25, 1977

[54] VEHICLE DETECTOR

[75] Inventors: Cabell N. Pryor, Jr., Silver Spring, Md.; Edward Hug, McLean, Va.; Michael H. Stripling, Silver Spring, Md.

[73] Assignee: The United States of America as represented by the Secretary of the Navy, Washington, D.C.

[22] Filed: Jan. 14, 1970

[21] Appl. No.: 8,158

[52] U.S. Cl. ..... 340/15; 340/261

[51] Int. Cl.[2] ..... G08B 13/00

[58] Field of Search ..... 340/258 D, 261, 38 R, 340/15, 16; 324/77 B, 77 C, 77 D, 77 G

[56] References Cited

UNITED STATES PATENTS 3,258,762 6/1966 Donner ..... 340/16 X 3,662,326 5/1972 Dennis, Jr. ..... 340/15

OTHER PUBLICATIONS

Wilson, *Electronics*, vol. 39, No. 3, Feb. 7, 1966.

*Primary Examiner*—Richard A. Farley

[57] ABSTRACT

A line spectrum detector to distinguish motor vehicles acoustically in the presence of background noise. The detector senses periodic signals, such as the firing rates of internal combustion engines, by using a swept phase-lock loop spectrum analyzer and passes the sensed signals to a logic network which measures the frequency stability of the sensed signal to distinguish motor vehicles from aircraft vehicles and the like.

9 Claims, 3 Drawing Figures

INVENTORS
Cabell N. Pryor, Jr
Edward Hug
Michael Stripling
BY J. O. Tresansky
ATTORNEY INVENTORS
Cabell N. Pryor, Jr
Edward Hug
Michael Stripling

BY

ATTORNEY

VEHICLE DETECTOR

BACKGROUND OF THE INVENTION

This invention relates generally to the art of vehicle detection and in particular to a device for detecting and distinguishing motor vehicles from other vehicles.

A wide variety of vehicle detectors have been available in the past, including such devices as optical photocell systems, direct pressure responsive devices, seismic signal sensors, and acoustic or sonic signal transducers. Of these, some provide adequate response only if they are carefully placed directly within the roadway over which pass the vehicles to be detected. For example, photocell systems must be carefully placed so that a light beam produced by a source mounted on one side of the road directly impinges upon a photocell mounted on the other side of the road. Similarly, devices which respond to the direct pressure exerted by the wheels of passing motor vehicles are presently available but these also require direct placement in the roads over which the motor vehicles pass. The shortcomings of such deployment techniques in enemy controlled areas are obvious.

Other types of sensors, such as seismic detectors, are capable of somewhat more flexible emplacement but still must be implanted in the ground in the immediate area of a particular roadway to provide accurate detection of the passage of vehicles thereon. Thus, optical, direct pressure, and seismic sensors require careful placement, and, therefore, are not suitable for rapid deployment in remote or hostile areas by such desirable methods as dropping from aircraft in the approximate vicinity of suspected roadways.

Similarly, the sonic and acoustic sensing devices presently available, while not requiring the localized emplacement of the aforedescribed sensors, have been found unsuitable in that they lack the capability of distinguishing among acoustic signals emanating from very similar sources. For example, previously available sensors are generally incapable of distinguishing the sounds generated by motor vehicles from those produced by piston powered boats or airplanes passing in the vicinity.

SUMMARY OF THE INVENTION

Accordingly, one object of this invention is to provide an improved vehicle detector which may be rapidly deployed in the general vicinity of motor vehicle traffic desired to be controlled.

Another object of the present invention is to provide a motor vehicle detector that may be emplaced at a distance from a suspected roadway, yet will remain effective.

Another object of the instant invention is to provide an improved motor vehicle detector that may be air dropped in the general vicinity of suspected motor vehicle traffic.

Yet another object of this invention is to provide a vehicle detector capable of distinguishing between piston powered motor vehicles and other piston powered machines.

A still further object of the invention is to provide a device for classifying acoustic spectral lines according to their source.

Briefly, these and other objects are achieved by acoustically detecting periodic signals, such as firing rates of internal combustion engines, and measuring the frequency stability of these signals to selectively distinguish the periodic signals generated by aircraft, boats and the like from those generated by motor vehicles.

BRIEF DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein.

DESCRIPTION OF THE PREFERRED EMBODIMENT

Figure 1:
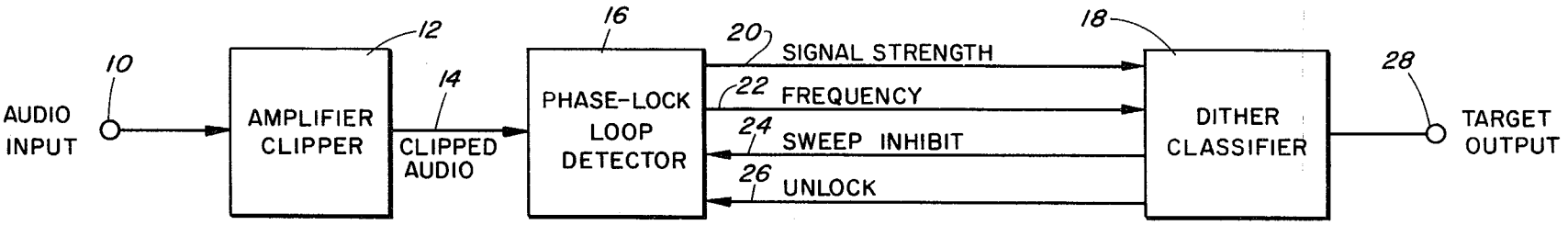
FIG. 1 is a block diagram showing the interrelationship of various subsystems of the overall vehicle detector of the instant invention.

Referring now to the the drawings wherein like reference characters designate identical or corresponding parts throughout the several views, and more particularly to FIG. 1 thereof, the vehicle detector system is shown as including an input terminal 10 which may be coupled to a conventional audio signal transducer such as a microphone, which has a good frequency response in the relatively low frequency range appropriate to the instant invention. The input terminal 10 is coupled to a clipper-amplifier 12, which is provided with a bias level control to establish a clipping threshold such that the amplifier produces an output only if the input audio signal has an amplitude above a selected minimum. For example, it has been found that such a suitable minimum level may be a sound pressure of approximately 0.002 microbar. Below the selected level the clipping circuits of the clipper-amplifier do not change state and the amplifier produces no output.

The clipped audio signal from amplifier 12 is passed through a coupling line 14 to a phase-lock loop detector 16. The phase-lock loop detector, described in detail hereinafter, detects and tracks discrete spectral lines or frequencies in the spectrum of the clipped signal from clipper-amplifier 12, and develops information as to the strength and stability of these lines for subsequent analysis.

Phase-lock loop detector 16 is coupled to a dither or fluctuation classifier 18, which evaluates the short term stability of each discrete frequency or spectral line being tracked by phase-lock loop detector 12, and classifies the line as representing either a motor vehicle or some other sonic source according to its stability. Phase-lock loop detector 16 provides signal strength and frequency stability information to dither classifier 18 through connecting lines 20 and 22, respectively. Dither classifier 18, in turn, partially controls the operation of phase-lock loop detector 16 by applying sweep inhibit and unlock control signals to the detector on intercoupling lines 24 and 26, respectively.

The output of dither classifier 18, and of the system as a whole, is taken from an output terminal 28. The output signal is either a logical one when a motor vehicle has been properly detected and classified or a logical zero when the audio input signal on terminal 10 does not meet the criteria for defining a motor vehicle signal established within the detector system.

It will be appreciated that the vehicle detector system disclosed is suitable for deployment in the form of a conventional air droppable acoustic buoy configuration, more commonly referred to as an "acoubuoy" configuration. This type of system is air dropped to a remote location and after the audio input has been processd as described herein, a radio frequency output signal corresponding to the target output signal is transmitted to a receiving station. When so configured, the audio input 10 will be coupled to the acoubuoy microphone and preamplifier.

Figure 2:
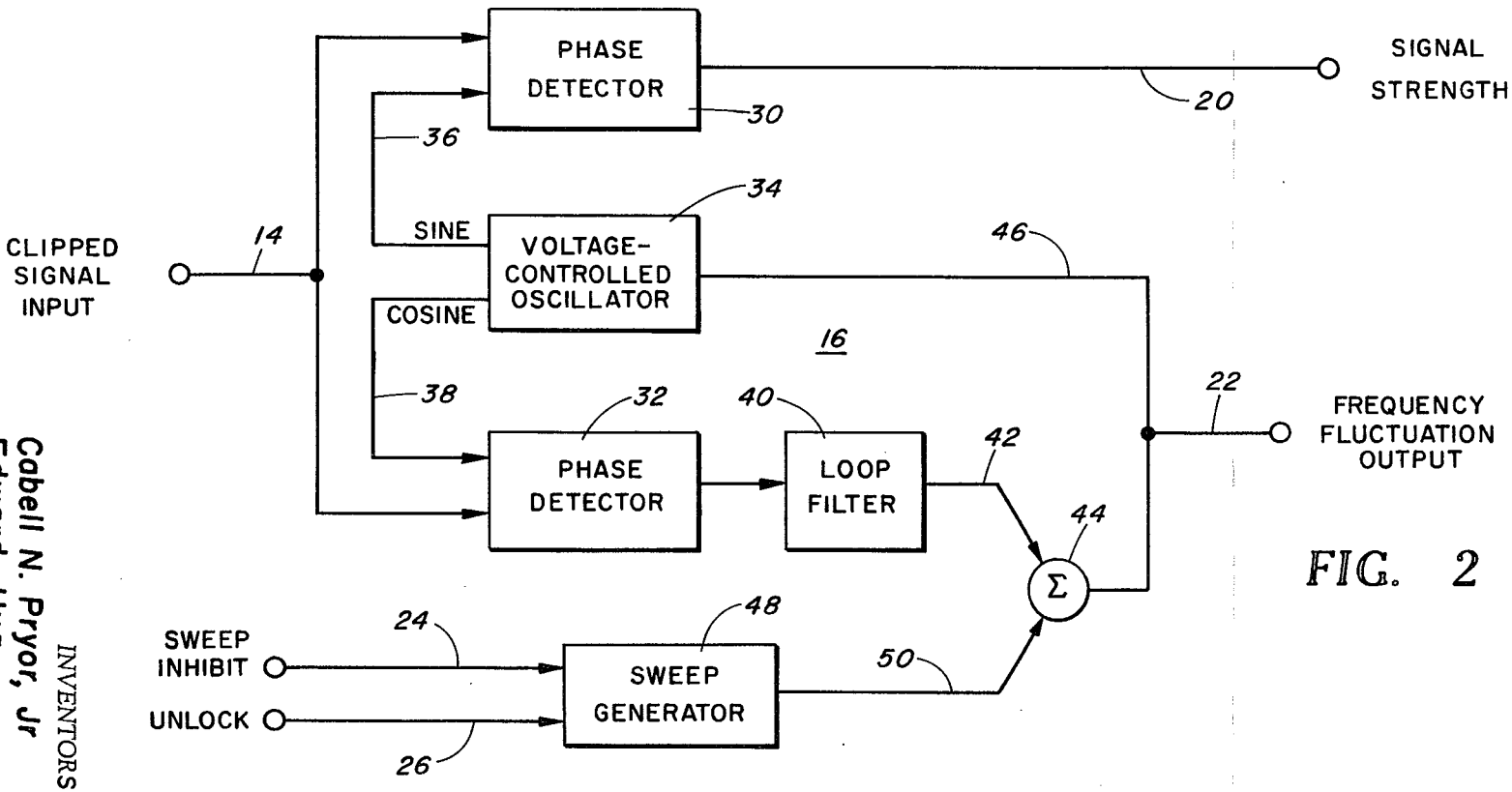
FIG. 2 is a block diagram of the phase-lock loop detector subsystem of the instant invention.

FIG. 2 illustrates in greater detail the phase-lock loop detector 16 of the detector system. The clipped audio output signal from amplifier clipper 12 is simultaneously applied via line 14 to a pair of phase detectors 30 and 32. Although the phase detectors may be of any suitable variety, they are preferably frequency multipliers which produce sum and difference output signals. The output of voltage controlled oscillator 34, producing both sine and cosine outputs (that is, outputs 90° out-of-phase), is coupled to both phase detectors via lines 36 and 38, respectively. A sine signal is applied to phase detector 20 and a cosine signal is applied to phase detector 32.

Phase detector 30 operates to provide a measure of the signal-to-noise ratio of the clipped audio input signal applied thereto by first multiplying the input audio signal with the applied sine voltage signal from oscillator 34 then developing an output voltage representing the average product of the multiplied signals. The average product will be zero for a noise input but reaches a maximum value for a coherent input signal.

In turn, phase detector 32 provides a comparison between the input audio signal frequency and phase and the frequency and phase of the applied cosine signal of oscillator 34. Since the oscillator output applied to phase detector 32 (cosine) is intended to be 90° out-of-phase with the input signal applied thereto, the output of phase detector 32 is zero when the applied cosine signal of the voltage controlled oscillator is at exactly the same frequency as the input signal. This result is achieved since the phase detector 32 develops the product of the input signal and the signal from oscillator 34. The resultant product signal has a sum component which is at twice the frequency of the input signal and a difference component which has a zero amplitude and frequency when the oscillator and input signals are equal in frequency and phase. When the oscillator and input signals are unequal in frequency or phase, phase detector 32 generates a control, or error signal, which is passed to a loop filter 40. The loop filter eliminates the high frequency components in the output of phase detector 32, and smooths or averages the low frequency component. The output of loop filter 40, which is essentially a slowly varying d.c. voltage, is applied through a conductor 42 to an adder 44, and then through a conductor 46 to voltage controlled oscillator 34. Thus, the error signal developed in phase detector 32 is fed back to, and controls, oscillator 34 thereby forming a feedback loop capable of locking onto and following the spectral line components of the input audio signal.

A sweep generator 48 is coupled by a conductor 50 to adder 44 for applying a cyclic output voltage, which may have a conventional sawtooth wave form, to voltage controlled oscillator 34 to cause the oscillator to sweep through a range of frequencies appropriate to the audio spectrum under consideration. Sweep inhibit and unlocking signals generated by dither classifier 18 are applied to sweep generator 48 on lines 24 and 26, respectively. It will be understood that the inhibit and unlocking signals are not essential since the voltage output of the sweep generator 48 is overwhelmed by the relatively large error signal developed by phase detector 32. Thus, even if the sweep generator is not inhibited, and continues to operate, the phase lock loop is capable of tracking spectral components of the input signal with reasonable accuracy.

Figure 3:
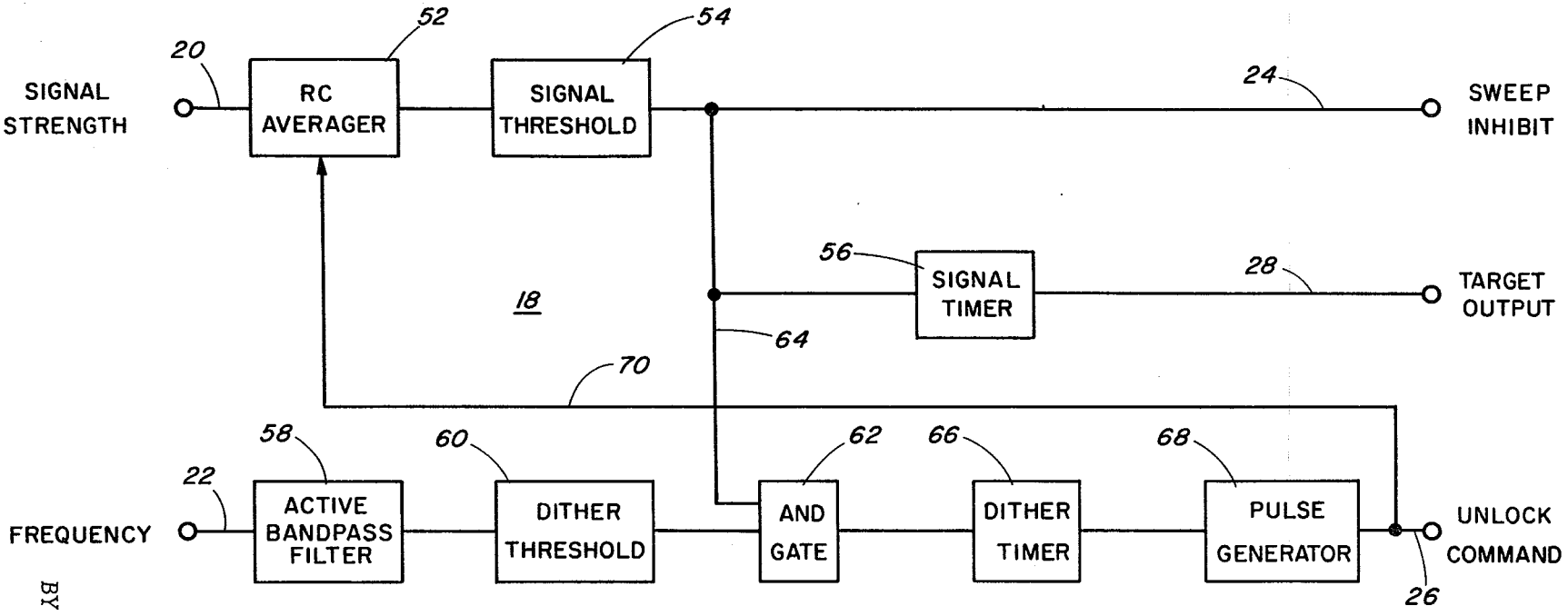
FIG. 3 is a block diagram of the dither classifier subsystem of the instant invention.

The output signals of phase-lock loop detector 16 are two voltages, one on line 20 representing the signal-to-noise ratio (or relative amplitude) of the spectral line being tracked, and the other on line 22 representing the frequency fluctuations of the same spectral component. These output voltage signals are applied to dither classifier 18 as shown in more detail in FIG. 3. The signal-to-noise ratio output signal on line 20 is applied to an RC averager 52, which may consist of a single RC low pass filter stage, for the purpose of filtering or averaging that output. Averager 52 is coupled to a threshold detector 54, which produces a logical one at its output when the averaged signal strength from averager 52 is above a selectable threshold value, and a logical zero when the averaged signal strength is below the same threshold. The threshold itself may be adjusted to set the sensitivity of the vehicle detector at a suitable level.

The output of threshold detector 54 is applied to line 24, which is coupled to sweep generator 48, to provide a sweep inhibit signal for stopping the sweep generator when a signal of suitable strength has been detected by the system. The output of threshold detector 54 is also applied to signal timer 56 which generates a detected target output after the lapse of a preset time interval.

The output of signal timer 56 is a logical zero whenever the input from threshold detector 54 is zero, but becomes a logical one after the input from the signal threshold detector 54 has been a logical one continuously for the set interval of the timer. Once set, the timer output remains logical one until the input from the threshold detector returns to logical zero.

The frequency fluctuation output on line 22 is applied to an active band pass filter 58. It is important to understand that the frequency fluctuation signal applied to band pass filter 58 contains the important information used to distinguish motor vehicles from aircraft and other types of sonic sources. In this respect it should be noted that the exact frequency of the input signal, determined by the phase lock loop detector, is not used by the dither classifier. Only the fluctuations or dither in the detected frequency is needed, since the fluctuations represent the information that distinguishes motor vehicles from other types of similar acoustic sources according to the basic principle of the instant invention.

The pass band of active filter 58 may have a selected low frequency range of approximately 0.15 to 0.4$H_z$, which range includes the normally expected range of fluctuations that motor vehicle sounds are likely to undergo, but excludes the extremely low frequency fluctuations that might be caused by such phenomena as aircraft circling above, or power boats proximate to the detector. The filter also excludes relatively high frequency fluctuations which may be caused by explosions, gun fire, or other spurious noise sources.

The output of filter 58 is fed to a dither threshold detector 60 which produces a logical zero output whenever the output of the filter exceeds a selectable threshold. The output of threshold detector 60 changes to a logical one whenever the threshold is not exceeded, thus providing what is in effect a negative indication of the detection of an appropriate signal. That is, a one output from dither threshold detector 60 indicates that if any signal is being detected, its fluctuations do not fall within the range set by filter 58, and thus is not likely to represent a motor vehicle.

The output of threshold detector 60 is applied to an AND gate 62 which receives a second signal from threshold detector 54 through a coupling line 64. AND gate 62 produces a logical one output only when both of its inputs are logical one, and produces a zero output at all other times. In effect this means that AND gate 62 generates a non-zero output only if a spectral line of suitable magnitude but undesirable frequency fluctuations is detected by the system.

A dither timer 66 is coupled to and receives the output of AND gate 62. The dither timer remains inactive as long as the output of AND gate 62 is zero, but is activated whenever the AND gate output becomes a logical one. Once activated the timer continues to run as long as the input from AND gate 62 remains a logical one, or until the dither timer interval expires. This interval is preferably eleven seconds, although it may be modified at will to meet specific systems requirements.

If dither timer 66 is permitted to run until its timing interval expires, it triggers a pulse generator 68. The pulse generator output is applied through a coupling line 70 to RC averager 52, resetting the averager. Resetting of averager 52 automatically causes the threshold detector 54 to switch to its zero output state, thereby resetting timer 56.

Thus, the dither classifier logic prevents a detected target signal from being generated by signal timer 56 whenever the input signal from detector 16 has a fluctuation frequency that falls outside the pass band of filter 58 for at least a period of time equal to the dither timer interval.

It will be appreciated that outputs from pulse generator 68 are also applied to line 26 as an unlock command to restart sweep generator 48. The function of signal timer 56 is to retard the generation of an output signal until after the dither timer has had a chance to run and thus until the dither classifier has had a chance to classify the input signal. To accomplish this function, the interval of signal timer 56 must be longer than that of dither timer 66. In fact, the ratio of the timing intervals of signal timer 56 and dither timer 66 determines how many times the dither classifier looks at a particular signal before developing a decision that it is or is not an appropriate target. It has been found that best results are achieved if the dither timer is set for an eleven second interval and the signal timer is set for an eighteen second interval. This provides a ratio slightly less than two, indicating that, on the average, a signal will be looked at slightly less than two times before an output decision is made. This ratio, of course, may be modified to further increase the reliability of the system at the expense of slower response time.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A motor vehicle detector comprising:
means for amplifying and clipping an audio input signal,
means for locking onto and tracking prominent spectral components of said audio input signal,
said locking and tracking means including
means for producing a first signal representing the signal-to-noise ratios of said prominent spectral components,
means for producing a second signal representing the frequency fluctuations of said prominent spectral components; and
classifying means coupled to said locking and tracking means for producing a detected target output only if said first and second signals possess a selected temporal relationship.

2. A motor vehicle detector as in claim 1 wherein:
said locking and tracking means includes a voltage controlled oscillator.

3. A motor vehicle detector as in claim 2 wherein:
said means for producing said first and second signals are phase detectors.

4. A motor vehicle detector as in claim 1 wherein:
said classifying means includes first threshold detector means for receiving and generating an output in response to the amplitude of said first signal reaching a selected level,
filter means for receiving and establishing a pass band for said second signal; and
second threshold detector means coupled to said filter means for generating an output indicative of the absence of a signal within said pass band of said filter.

5. A motor vehicle detector as in claim 4 wherein:
said classifying means further includes AND gate means coupled to said first and second threshold detectors for generating an output only when said first and second threshold detectors simultaneously produce outputs.

6. A motor vehicle detector as in claim 5 wherein:
said classifying means further includes first timing means coupled to said AND gate for initiating a first time interval in response to the reception of an output from said AND gate,
said first timing means coupled to said first threshold detecting means for resetting it at the termination of said first time interval.

7. A motor vehicle detector as in claim 6 wherein:
said classifying means further includes second timing means coupled to said first threshold detector means for initiating a second timing interval in response to the generation of an output by said first threshold detector,
said second timing means producing said detected target output at the termination of said second time interval.

8. A motor vehicle detector comprising:
means for amplifying and clipping an acoustic signal,
phase-lock loop detector means coupled to said amplifying and clipping means for detecting and tracking prominent spectral components in the output thereof,
said phase-lock loop detector means including
an oscillator means for producing a variable frequency output in response to the application of a control voltage, first and second phase detector means coupled to said amplifying and clipping means and to said oscillator means for comparing the phase of said outputs of said amplifying and clipping means and said oscillator means, said first phase detector means generating an output representing the signal-to-noise ratio of said output of said amplifying and clipping means, said second phase detector means generating an output representing the fluctuations in frequency of said prominent spectral components;

dither classifying means coupled to said phase-lock loop detector means for receiving and classifying said outputs of said first and second phase detector means, said dither classifying means including;

filter means for establishing a frequency pass band, first threshold detector means coupled to said filter means for generating a signal indicative of the absence of a signal within the pass band defined by said filter means, second threshold detector means coupled to said first phase detector for generating a signal indicative of the presence of a signal of suitable signal-to-noise ratio; and first and second timing means coupled to said first and second threshold detector means respectively, for initiating first and second timing intervals, respectively in response to the signals generated by said threshold detectors, said first timing means coupled to said second timing means for disabling said second timing means, said second timing means generating a detected target output at the termination of said second timing interval when not disabled by said first timing means.

9. A spectral line classifier comprising:

filter means for establishing a frequency pass band, first threshold detector means coupled to said filter means for generating a signal indicative of the absence of a signal within said pass band, second threshold detector means for generating a response indicative of the presence of a spectral line of suitable signal-to-noise ratio, first and second timing means coupled to said first and second threshold detector means, respectively, for initiating first and second timing intervals, respectively, in response to outputs generated by said threshold detectors;

said first timing means coupled to said second timing means for disabling said second timing means, said second timing means generating an output at the termination of said second timing interval indicative of the presence of a spectral line of suitable signal-to-noise ratio and having frequency fluctuations within said pass band when not disabled by said first timing means.

* * * * *